United States Patent [19]

Kearney

[11] Patent Number: 4,568,036

[45] Date of Patent: Feb. 4, 1986

[54] WHEEL-OPERATED WINCH

[76] Inventor: Morris J. Kearney, Rte. 1, Box 155, Minden, La. 71055

[21] Appl. No.: 621,948

[22] Filed: Jun. 18, 1984

[51] Int. Cl.[4] ..... B65H 17/46; B66D 3/26

[52] U.S. Cl. ..... 242/95; 52/157; 248/225.31; 254/323; 254/389

[58] Field of Search ..... 242/95, 86.5 R; 254/263, 325, 389, 323; 180/7.5, 53.61; 52/157; 248/231.4, 225.31, 72; 292/115, 256.73

[56] References Cited

U.S. PATENT DOCUMENTS

| | | | |
|---|---|---|---|
| 728,609 | 5/1903 | Pitcher | 52/157 X |
| 1,054,831 | 3/1913 | De Peel | 242/95 X |
| 1,394,703 | 10/1921 | Wright | 242/95 |
| 1,480,035 | 1/1924 | Warrick et al. | 242/95 |
| 1,528,656 | 3/1925 | Crafar | 242/95 |
| 1,901,261 | 3/1933 | Ramos | 242/95 |
| 2,341,048 | 2/1944 | Kopp | 248/225.31 |
| 2,923,995 | 2/1960 | Homma | 248/225.31 X |
| 3,099,416 | 7/1963 | Wright | 242/95 |
| 3,132,823 | 5/1964 | Domines | 242/95 |
| 3,278,159 | 10/1966 | Jack | 242/95 |
| 3,793,786 | 2/1974 | Jahnke | 52/157 |
| 4,160,472 | 7/1979 | Blackstone | 180/53.61 X |

*Primary Examiner*—Stuart S. Levy
*Assistant Examiner*—Lynn M. Sohacki
*Attorney, Agent, or Firm*—John M. Harrison

[57] ABSTRACT

A wheel-operated winch assembly which includes in a preferred embodiment and as a first element, a generally cylindrically-shaped cable drum divided by spaced flanges which define a cable seat and a drum base extending from the cable drum and having base tabs for mounting to a base plate which is bolted to the wheel rim of an automobile. A cable is wound on the cable seat, the free end of the cable is attached to a tree or other point of anchor and the vehicle wheel is rotated to wind the cable on the cable drum and extract the vehicle from mud, snow, sand or ice. As a second element in the assembly, a cable guide is attached to the bumper of the vehicle and the cable is extended through a guide tube in the cable guide from the drum to the point of attachment. An optional third element in the wheel-operated winch assembly is a cable anchor characterized by a shaft having an earth auger at one end and an anchor plate and shaft eye at the opposite end for securing the cable, when no other point of anchor is available.

1 Claim, 11 Drawing Figures

WHEEL-OPERATED WINCH

BACKGROUND OF THE INVENTION

1. Field of the Invention

This invention relates to devices for removing a vehicle from a mired condition or from an icy or snowy location wherein the driven wheels of the vehicle have lost their tractive ability. More particularly, the invention relates to a wheel-operated winch assembly which is capable of being mounted on the driven wheel of a vehicle to cause the vehicle to remove itself from a mired or immobile position by operation of the powered wheel or wheels. The wheel-operated winch assembly of this invention is characterized in one embodiment by a cable drum which is removably attached to a base plate secured to the rim of a vehicle by means of lug nuts, which cable drum contains a coiled cable for attachment to a tree, anchor device or other immobile object, in order to facilitate movement of the vehicle. In a second preferred embodiment of the invention the wheel-operated winch assembly includes as a second element in the assembly, a bumper-mounted cable guide located between the cable drum and the object to which the end of the cable is attached, in order to guide the cable and prevent snarling and entanglement of the cable beneath the wheels or in the frame of the vehicle. An optional third element in the wheel-operated winch assembly is a cable anchor which includes a shaft provided with an earth auger at one end and an eye at the opposite end and a curved anchor plate secured to the shaft immediately below the eye, in order to anchor the free end of the cable when no tree, stump, post or other point of anchor is available.

2. Description of the Prior Art

The powered wheels of vehicles have been used in the prior art as a source of motive power for various purposes. It is known, for example, to mount a winch drum on the driven rear wheel of a vehicle and to anchor one end of a cable wound on the winch drum to a solid object spaced from the vehicle, in order to remove the vehicle from a mired or immobile condition. The driven vehicle wheels have also been used for power take-off purposes in the past and even to accomplish such tasks as splitting wood, using a rotating auger device mounted on the rim of the wheel. An early winch for mounting on the driven wheels of a vehicle is disclosed in a "Draft Appliance for Automobiles" in U.S. Pat. No. 1,054,831, patented on Mar. 4, 1913, to G. V. DePeel. The apparatus of this invention includes a spool mounted to the hub of the driven rear wheel and threaded through a tension or friction guide carried by the bumper to a stake, tree or other immobile object. The wheel is then turned by racing the engine, to wind the rope on the spool and remove the car from its immobilized position. U.S. Pat. No. 1,394,703, dated Oct. 25, 1921, to J. H. Wright, discloses an "Automobile Puller" which includes a drum-shaped device adapted to be secured on the hub of the driven wheel of a vehicle and a cable or rope wound on the drum and attached to an immobile object, such as a tree or stake, in order to remove the vehicle from a mired or immobilized position. A "Vehicle Extricating Device" is disclosed in U.S. Pat. No. 1,480,035, dated Jan. 8, 1924, to O. S. Warrick, et al. This device includes a pair of drums attached to the driven wheels of a vehicle and a pair of ropes or cables attached to a stake or immobilized object in order to facilitate removal of the vehicle from a mired or immobilized position by operation of the driven wheels. Another drum-type winch device designed to mount on the rear wheels of a vehicle and remove the vehicle from a mired condition, is illustrated in U.S. Pat. No. 1,528,656, dated Mar. 3, 1925, to H. Crafar. The Crafar device includes a drum attached to the driven wheel of a vehicle by means of a flanged ring, which ring can be selectively locked to the drum, as desired. A cable or rope having one end secured to the flanged ring is wound around the drum and is then tied or otherwise secured to a tree, stump, post, anchor device or other immobile object and power is transmitted to the driving wheel to remove the vehicle from its mired or immobilized condition, as the cable or rope winds on the drum. U.S. Pat. No. 1,901,261, dated Mar. 14, 1933, to S. K. Ramos, discloses an "Automobile Extractor" which includes a pair of detachable sleeve reels temporarily attached to the end of the propelling shaft or the hub of the motor-driven wheel of a vehicle, with one reel located on each side. Each reel is designed to receive a cable or rope thereon and the ropes or cables are extended from the reel devices to a tree or other immobile object and power is supplied to the wheels in order to wind the ropes or cables on the reels and move the vehicle. A "Removable Vehicle-Powered Winch or Pulley" is dislosed in U.S. Pat. No. 3,099,416, dated July 30, 1963, to N. B. Wright. The Wright pulley includes a mounting flange which is attached to the lug studs on a vehicle wheel and a winch drum pinned to the mounting flange and adapted to receive one end of the cable, the opposite end of the cable being attached to a tree, stump, anchor device or alternative immobile object, in order to remove the vehicle from a mired or immobilized condition by supplying power to the driven wheels. U.S. Pat. No. 3,278,159, dated Oct. 11, 1966, to C. A. Jack for "Winch Attachments for Driven Wheels of Automobiles", discloses a similar drum-shaped device for mounting on the drum wheels of a vehicle, with a bumper guide device for guiding a cable wound on the drum and attached to a tree or other object, in order to remove the vehicle from a mired or immobilized condition.

It is an object of this invention to provide a new and improved wheel-operated winch assembly which includes a wheel-driven winch capable of being quickly and easily atached to the wheel rim of a vehicle and used in cooperation with a bumper-mounted cable guide and an optional cable anchor to remove the vehicle from a mired or immobilized condition by utilizing the power of the vehicle itself.

Another object of this invention is to provide a new and improved wheel-operated winch assembly which is characterized by a drum mounted to the wheel studs of a vehicle and provided with a cable wound on the drum and extending to an immobile object through a bumper-mounted cable, whereby the vehicle can be moved by rotating the wheel to which the drum is attached and winding the cable on the drum.

Yet another object of this invention is to provide a new and improved wheel-operated winch assembly which incorporates a winch characterized by a drum having flanges or fittings for attachment to the wheel studs of a vehicle wheel, a bumper-mounted cable guide with adjustable attachment brackets for receiving a cable wound on the drum and guiding the cable in order to stabilize the vehicle as the vehicle wheel is driven and the cable winds on the drum, and one or more cable anchors, each having a shaft with an earth auger provided on one end and an anchor plate secured to the shaft near the opposite end to provide a point of anchor for the cable under circumstances and in terrain where no other point of anchor is available.

SUMMARY OF THE INVENTION

These and other objects of the invention are provided in a wheel-operated winch assembly which includes a wheel-operated winch characterized by a cable drum provided with a wound length of cable, the cable drum adapted for removable attachment to the wheel rim of a vehicle, and in a preferred embodiment and as a second element of the assembly, a bumper-mounted cable guide having a tubular guide tube and adjustable attachment brackets for guiding the cable to an immobile object such as a tree, stump, or an alternative anchoring device, which winch operates to remove the vehicle from a mired or immobile position by supplying power to the wheel to which the is attached. In another preferred embodiment of the invention, and as an optional third element provided in the wheel-operated winch assembly, a cable anchor having an earth auger and an anchor plate is provided, for anchoring the cable when no other anchor is available.

BRIEF DESCRIPTION OF THE DRAWINGS

The invention will be better understood by reference to the accompanying drawings, wherein.

DESCRIPTION OF THE PREFERRED EMBODIMENTS

Figure 1:
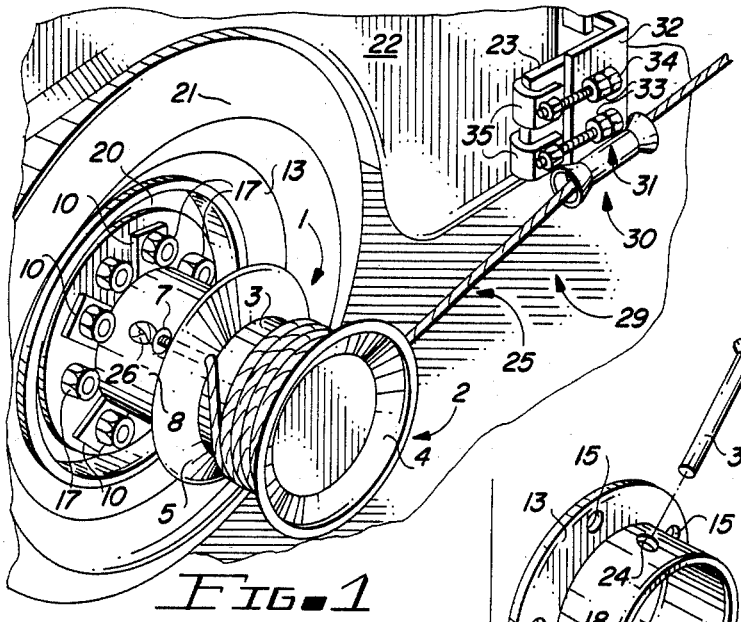
FIG. 1 is a perspective view, partially in section, of a preferred embodiment of the wheel-operated winch of the wheel-operated winch assembly, with an accompanying bumper-mounted cable guide secured to the left rear segment of the bumper of a vehicle.
Figure 4:
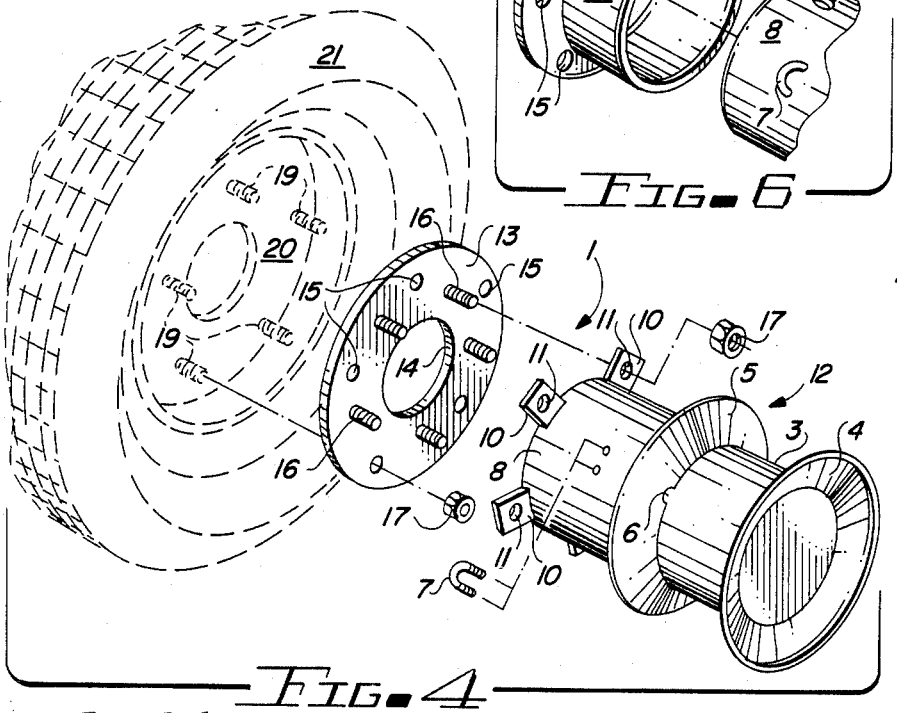
FIG. 4 is an exploded view of a preferred cable drum and base plate assembly of the wheel-operated winch.
Figure 5:
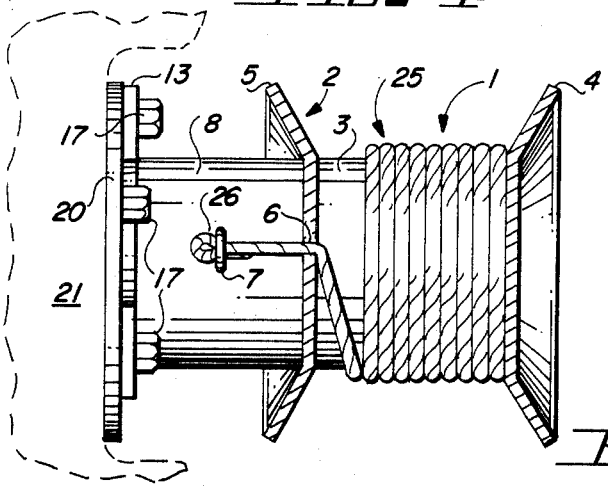
FIG. 5 is a partial sectional view of the cable drum wheel-operated winch illustrated in FIGS. 1 and 4.
Figure 8:
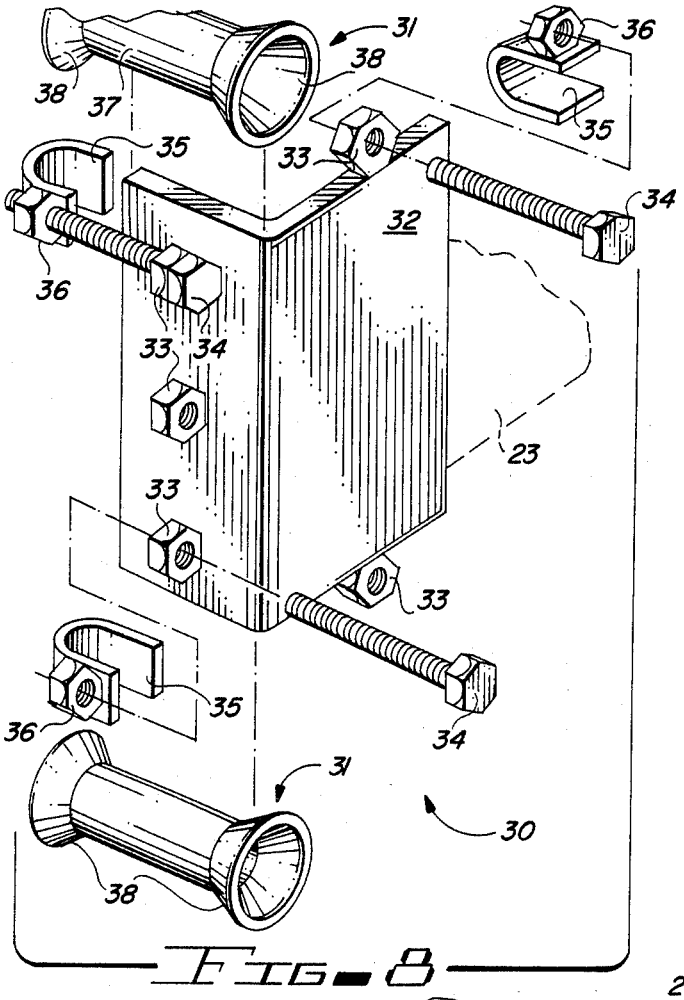
FIG. 8 is an exploded view of the bumper-mounted cable guide illustrated in FIG. 1.
Figure 9:
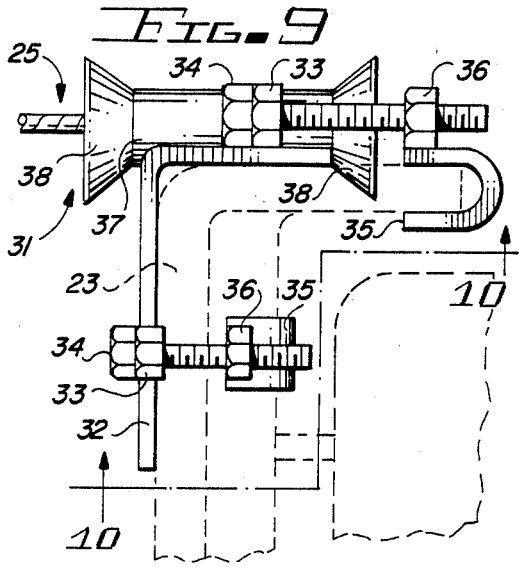
FIG. 9 is a top view of the cable guide illustrated in FIG. 8.
Figure 10:
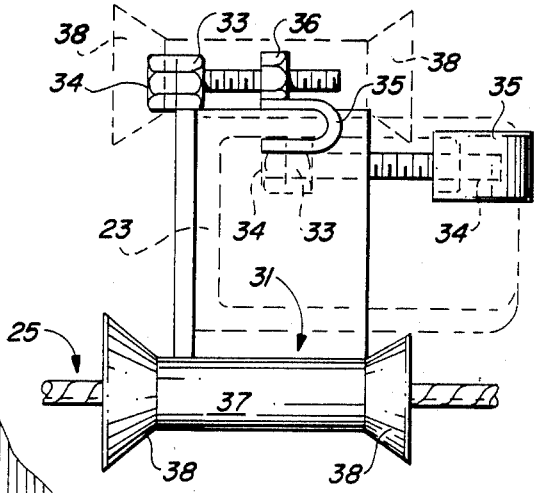
FIG. 10 is a side sectional view of the cable guide illustrated in FIGS. 8 and 9, taken along line 10—10 in FIG. 9, with an optional second guide tube illustrated in phanton.

Referring initially to FIGS. 1, 4 and 5 of the drawings and to FIG. 1 in particular, the wheel-operated winch 1 and cable guide 30 are preferred components of a winch assembly which is generally illustrated by reference numeral 29. The wheel-operated winch 1 is characterized in a preferred embodiment by a cable drum 2, provided with an outer flange 4 and an inner flange 5, spaced by a cable seat 3. A supply of cable 25 is wound on the cable seat 3 between the outer flange 4 and the inner flange 5 and the free end of the cable 25 extends through the guide tube 31 of the cable guide 30, for purposes which will be hereinafter described. As illustrated in FIG. 4, a cable slot 6 is provided in the base of the inner flange 5 adjacent the cable seat 3 and serves to facilitate passage of the tethered end of the cable 25 through the inner flange 5, for attachment to the generally cylindrically-shaped drum base 8. The legs of the U-bolt 7 serve to secure a loop in the drum end 26 of the cable 25 by means of a pair of nuts (not illustrated) which are threaded on the legs of the U-bolt 7. Multiple base tabs 10 extend radially from the drum base 8 and are provided with base tab apertures 11 for registration with the spaced base plate studs 16, extending from the base plate 13. The base plate 13 is in turn provided with a central opening 14 and with wheel stud openings 15, which register with the conventional wheel studs 19, attached to the rim 20 of the vehicle 22. A tire 21 is mounted on the rim 20 in conventional fashion and the base plate 13 is secured to the rim 20 by means of conventional lug nuts 17. Additional lug nuts 17 threadibly engage the base plate studs 16 of the base plate 13 to removably secure the base tabs 10 and the wheel-operated winch 1 to the base plate 13.

Figure 6:
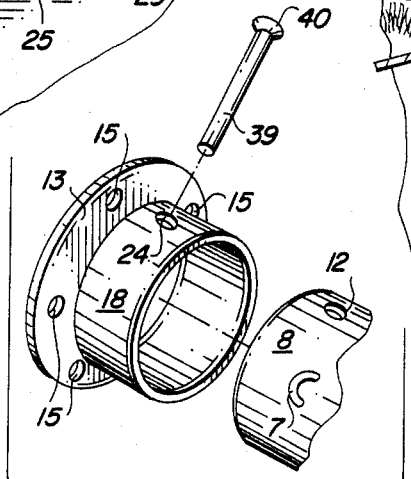
FIG. 6 is a perspective view of an alternative base plate and cable drum connecting means for the wheel-operated winch.

Referring now to FIG. 6 of the drawings, in another preferred embodiment of the invention the drum base 8 of the wheel-operated winch 1 is fitted with a drum mount aperture 12 and the base plate 13 is provided with a base plate flange 18, which is sufficiently large to receive the drum base 8 in concentric relationship. The base plate flange 18 is provided with a flange aperture 24 which extends transversely through opposite surfaces of the base plate flange 18, and is designed to register with the drum mount aperture 12 in the drum base 8, when the drum base 8 is inserted inside the base plate flange 18. When the flange aperture 24 registers with the drum mount aperture 12, the pin 39, having pin grip 40, is inserted through the aligned flange aperture 24 and drum mount aperture 12, in order to removably connect the drum base 8 and the wheel-operated winch 1 to the base plate 13. As in the case of the base plate 13 illustrated in FIGS. 1 and 4 of the drawings, the base plate 13 illustrated in FIG. 6 is provided with multiple wheel stud openings 5 for receiving the wheel studs 19, in order to secure the base plate 13 to the rim 20 by means of lug nuts 17.

Referring now to FIGS. 1 and 8–11 of the drawings in a preferred embodiment of the invention the cable guide 30 is secured to the bumper 23 of the vehicle 22 by means of a bumper plate 32 and cooperating bumper clamps 35, which are connected to the bumper plate 32 by means of clamp bolts 34. The clamp bolts 34 extend through guide nuts 33, provided with an interior opening which is larger than the threads in the clamp bolts 34, and threadibly engage the clamp nuts 36, which are secured to the bumper clamps 35 by means of a weld or other means, to secure the clamp bolts 34. In this manner, the bumper plate 32, which also carries a guide tube 31, can be secured to the bumper 23 by tightening the clamp bolts 34 in the guide nuts 33. In a preferred embodiment of the invention, as many as four sets of the clamp bolts 34, guide nuts 33, clamp nuts 36 and bumper clamps 35 can be used to removably attach the bumper plate 32 to the bumper 23 of a vehicle 22. Accordingly, as further illustrated in FIG. 1 of the drawings the cable 25 is extended through the guide tube 31 mounted to the bumper plate 32, in order to better control the wheel-operated winch 1, as hereinafter described. Referring again to FIGS. 8–11 of the drawings, in another most preferred embodiment of the invention the guide tube 31 includes a generally cylindrically-shaped tube body 37, having flared ends 38, to better receive and guide the cable 25.

Figure 2:
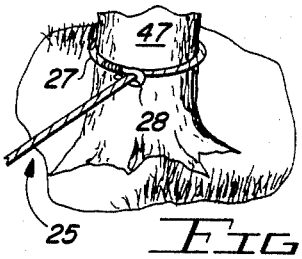
FIG. 2 is a perspective view of a means for anchoring the free end of the cable.

Referring now to FIG. 2 of the drawings in yet another preferred embodiment of the invention the terminal end 27 of the cable 25 is provided with a cable hook 28 which can be used to attach the cable 25 to a tree 47, in order to securely anchor the terminal end 27 of the cable 25. It will be appreciated by those skilled in the art that the terminal end 27 of the cable 25 can be similarly attached to any relative immobile object, such as a stump, post, or like object, if such an anchor is available, in order to secure the cable 25 and facilitate operation of the wheel-operated winch 1.

Figure 3:
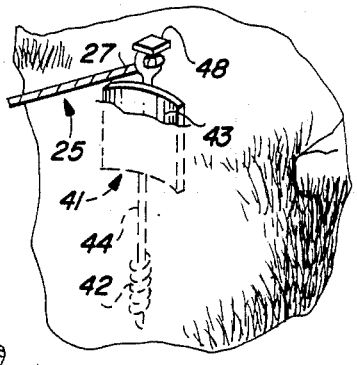
FIG. 3 is a perspective view of a cable anchor element of the wheel-operated winch assembly, for anchoring the extending end of the cable when no other point of anchor is available.
Figure 7:
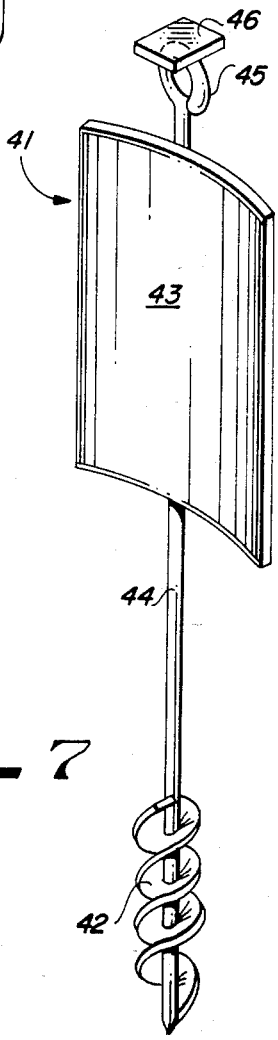
FIG. 7 is a perspective view of a preferred cable anchor for securing the free end of the cable.

Referring now to FIGS. 3 and 7 of the drawings, under circumstances where a suitable anchor such as a tree 47 is not available, a third element of the winch assembly 29 is provided in the form of a cable anchor 41, which includes an earth auger 42 disposed at one end of a shaft 44 and a curved anchor plate 43 positioned at the opposite end of the shaft 44. In another most preferred embodiment of the invention the upper end of the shaft 44 is shaped to define a shaft eye 45 and an eye plate 46 is welded or slidably secured to the top of the shaft eye 45, in order to provide a means for driving the cable anchor 41 into the ground. Under circumstances where the anchor plate 43 is welded to the shaft 44, rotation of the shaft 44 for deeper penetration of the cable anchor 41 is accomplished by inserting a bar, tire tool or other elongated implement in the shaft eye 45 and rotating the cable anchor 41 until the lower edge of the anchor plate 43 touches the ground, at which point the cable anchor 41 can be further driven into the ground by striking the eye plate 46 with a sledge hammer to position the anchor plate 43 at a desired depth, as illustrated in FIG. 3. Alternatively, and in a most preferred embodiment, the anchor plate 43 is detachable from the shaft 44 and can be slidably mounted on the shaft 44 according to the methods known to those skilled in the art, such as, for example, one or more of the U-bolts 7. Accordingly, the shaft 44 can be rotated and the earth auger 42 caused to penetrate the earth without rotating the anchor plate 43. Tha anchor plate 43 can then be driven into the ground independently of the shaft 44 to a desired depth. The cable hook 28 can then be inserted in the shaft eye 45 to provide a firm anchor for the terminal end 27 of the cable 25.

In operation, and referring again to FIGS. 1–4 and 11 of the drawings, when the vehicle 22 is mired, stuck or otherwise rendered immobile by sand, mud, ice or snow and is unable to gain traction, the wheel-operated winch assembly 29 can be used as follows. Referring initially to FIG. 4 of the drawings the base plate 13 is initially mounted to the rim 20 of one of the drive wheels of the vehicle 22 by removing the lug nuts 17, inserting the wheel stude 19 through the wheel stud openings 15 and re-tightening the lug nuts 17 on the wheel studs 19, as illustrated in FIGS. 1 and 5. The drum base 8 of the wheel-operated winch 1 is then secured to the base plate 13 by projecting the base plate studs 16 through the base tab apertures 11 in the base tabs 10 and threading additional lug nuts 17 on the base plate studs 16. The wheel-operated winch 1 is thus securely, but removably installed on the rim 20 as illustrated in FIG. 1.

Figure 11:
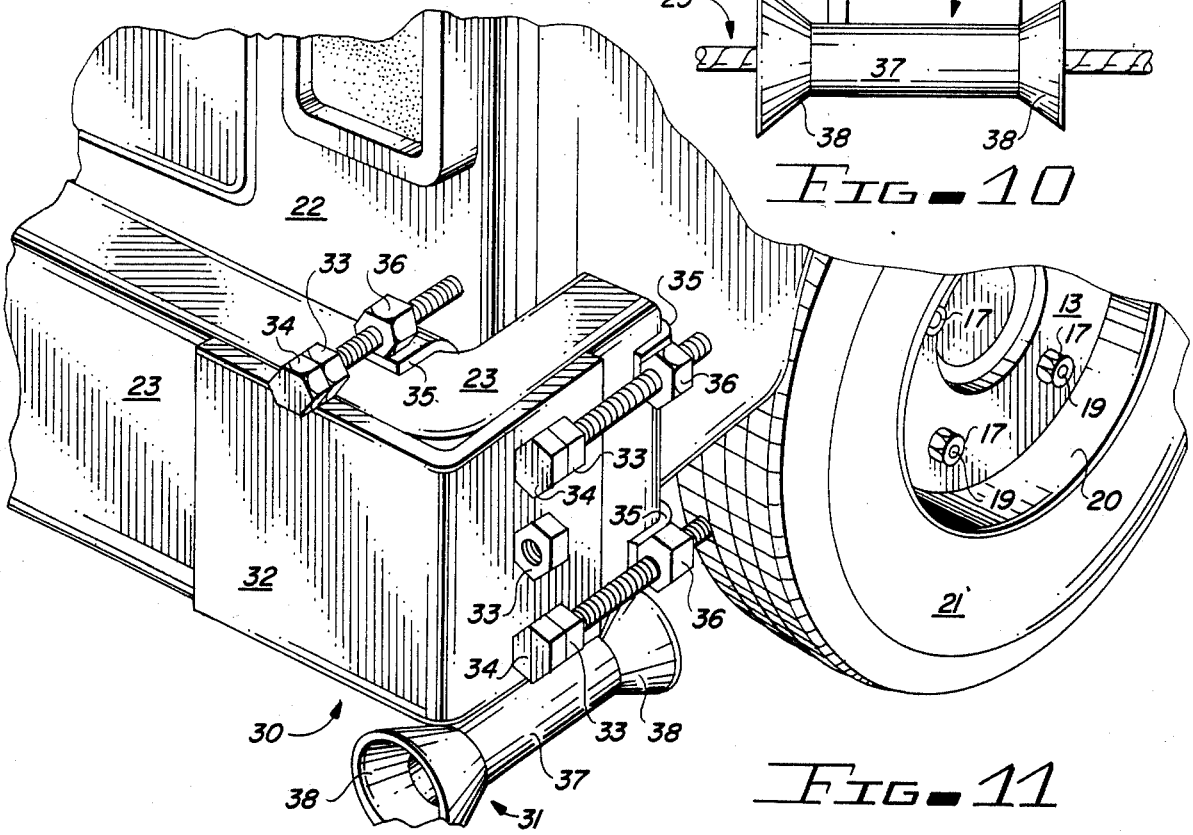
FIG. 11 is a perspective view of the cable guide mounted in functional position on the bumper of a vehicle.

Referring now to FIG. 11 of the drawings the cable guide 30 is mounted to an end segment of the bumper 23 corresponding to the same side of the vehicle 22 as the wheel-operated winch 1, by positioning the bumper clamps 35 as illustrated and tightening the clamp bolts 34 in the clamp nuts 36. When the cable guide 30 is so mounted on the bumper 23 as to substantially align with the cable seat 3 of the cable drum 2, the terminal end 27 of the cable 25 is threaded through the flared ends 38 and the tube body 37 of the lower guide tube 31, and is attached by means of the cable hook 28 to a tree 47, as illustrated in FIG. 2 of the drawings. If a tree 47 or other natural or existing anchor point is not available, then a cable anchor 41 can be driven into firm ground within the length of the cable 25, by initially driving the earth auger 42 into the ground and subsequently rotating the cable anchor 41 in the clockwise direction, by inserting a tire tool or other elongated object in the shaft eye 45. When the bottom edge of the anchor plate 43 has contacted the ground, the cable anchor 41 can be driven further into the ground by striking the eye plate 46 with a sledgehammer or other heavy object to firmly secure the cable anchor 41 in the earth, as illustrated in FIG. 3. The cable hook 28 can then be inserted in the shaft eye 45 to anchor the terminal end 27 of the cable 25 to the cable anchor 41. When the terminal end 27 of the cable 25 is so secured, the drive wheel of the vehicle 22 is engaged by the appropriate gearing and the wheel is caused to rotate, causing the cable 25 to wind on the cable seat 3 of the cable drum 2, and the vehicle 22 moves along the cable 25. In the embodiment of the invention illustrated in FIG. 1 the cable 25 winds on the cable drum 2 and the tire 21 rotates in a clockwise direction. Since the terminal end 27 of the cable 25 is firmly secured either to the tree 47, a cable anchor 41 or an alternative immobile object, the vehicle 22 must move toward the point of anchor as the cable 25 winds on the cable drum 2, and positioning the cable 25 through the lower guide tube 31 allows the driver of the vehicle 22 to more accurately control movement of the vehicle 22 toward the point of anchor. This is particularly true under circumstances where a pair of the wheel-operated winches 1 are supplied to both drive wheels and the cables 25 are extended through a pair of the guide tubes 31, provided on cable guides 30 located on each end of the bumper 23. Accordingly, the vehicle 22 can be easily advanced to a location where the drive wheels are able to gain traction by use of the cable-operated winch assembly 29.

It will be appreciated by those skilled in the art that an important element in the wheel-operated winch assembly 29 of this invention is the cable guide 30, which serves to prevent the cable 25 from becoming entangled in the bumper 23 or wrapped around the tire 21 or the frame of the vehicle 22. Furthermore, threading of the cable 25 through the lower guide tube 31 in the cable guide 30 serves to stabilize the vehicle 22 as it is pulled toward the point of anchor and reduces the maximum pulling force necessary to extricate the vehicle 22. It is understood that in a preferred embodiment of the invention two of the guide tubes 31 are provided in spaced relationship on the bumper plate 32, to facilitate mounting of the cable guide 30 on the opposite ends of each bumper by simply reversing the relative positions of the guide tubes 31 as the cable guide 30 is turned upside down. Another important element of the winch assembly 29 is the optional cable anchor 41, which is necessary to operate the wheel-operated winch assembly 29 under circumstances where there is no tree, stump, fence post or other object to which the terminal end 27 of the cable 25 can be attached, in order to provide a suitable anchor for the cable 25. Accordingly, in desert terrain and other arid areas where there are few trees, the cable anchor 41 becomes an indispensible element in the wheel-operated winch assembly 29. It will be further appreciated from a consideration of the design of the cable anchor 41 and referring again to FIGS. 3 and 7 of the drawings, that the curved anchor plate 43 serves to engage and cup the earth, in order to aid the anchoring characteristics of the cable anchor 41. Accordingly, as illustrated in FIG. 3 of the drawings the anchor plate 43 provides an expanded, curved surface area for engagement with the soil to enhance the integrity of the cable anchor 41.

It will be further appreciated by those skilled in the art and in consideration of FIGS. 8–11 of the drawings, that the cable guide 30 element of the winch assembly 29 can be quickly and easily mounted to the bumper 23 of substantially any vehicle by locating the bumper clamps on the inside of the bumper 23 and then using the clamp bolts 34 to secure the bumper plate 32 to the bumper 23. As many as four such clamp bolts 34 can be used, depending upon the degree of stability necessary, which degree of stability is a function of the weight of the vehicle 22.

Referring again to FIGS. 4 and 6 of the drawings, as heretofore described, the base plate 13 can be manufactured in two basic configurations, one of which includes a base plate flange 18, as illustrated in FIG. 6. Accordingly, the drum base 8 of the wheel-operated winch 1 can be mounted to the base plate 13 by using the pin 39 or by using lug nuts 17 as illustrated in FIG. 4, depending upon the particular design of the base plate 13 chosen.

While the preferred embodiments of the invention have been described above, it will be recognized and understood that various modifications may be made therein and the appended claims are intended to cover all such modifications which may fall within the spirit and scope of the invention.

Having described my invention with the particularity set forth above, what is claimed is:

1. A wheel-operated winch assembly for a vehicle having wheel studs comprising:

(a) a cable drum having an outer flange and an inner flange spaced by a cable seat;

(b) a length of cable wound on said cable seat of said cable drum, with one end of said cable secured to said cable drum;

(c) a drum base projecting from said cable drum and a plurality of base tabs extending from said drum base in transverse relationship, with tab apertures provided in said base tabs;

(d) a substantially round base plate provided with openings disposed in spaced relationship for registration with the wheel studs of a driven wheel on the vehicle and threaded base plate studs projecting in spaced relationship from said base plate, said base plate studs extending through said tab apertures in said base tabs;

(e) a first set of lug nuts threadably tightened on the wheel studs for securing said base plate on the driven wheel and a second set of lug nuts threadably tightened on said base plate studs for securing said drum base and said cable drum on said base plate;

(f) a generally L-shaped bumper plate positioned against the bumper of said vehicle and a cable guide tube carried by said bumper plate;

(g) three U-shaped clamps engaging the bumper, two of which are associated with the short side of the L-shaped bumper plate and one associated with the long side of the bumper plate and three first nuts secured to said clamps, respectively;

(h) three guide nuts secured to said L-shaped bumper plate, two on the short side of the plate and one on an edge of the long side of the bumper plate and located substantially in alignment with said first nuts, respectively;

three bolts extending in a direction parallel with each other through said guide nuts, respectively and threadably engaging said first nuts, respectively, whereby said bumper plate and said cable guide tube are removably secured to the bumper; and (j) a cable anchor characterized by a shaft, an earth auger provided on one end of such shaft, an eye shaped in the opposite end of said shaft and an anchor plate carried by said shaft, said anchor plate located near said eye, whereby said cable anchor is anchored in the earth and the free end of said cable is attached to said eye to anchor said cable.

* * * * *